US011788335B2

(12) United States Patent
Trautmann et al.

(10) Patent No.: US 11,788,335 B2
(45) Date of Patent: Oct. 17, 2023

(54) FASTENING DEVICE FOR A WINDOW LIFTER, AND WINDOW LIFTER

(71) Applicant: Brose Fahrzeugteile SE & Co. Kommanditgesellschaft, Bamberg, Bamberg (DE)

(72) Inventors: Michael Trautmann, Neudrossenfeld (DE); Hans Herzog, Strullendorf (DE); Michael Jahn, Bad Staffelstein (DE); Norman Huemmer, Ebensfeld (DE); Matthias Fischer, Michelau (DE)

(73) Assignee: Brose Fahrzeugteile SE & Co. Kommanditgesellschaft, Bamberg, Bamberg (DE)

( * ) Notice: Subject to any disclaimer, the term of this patent is extended or adjusted under 35 U.S.C. 154(b) by 0 days.

(21) Appl. No.: 17/765,865

(22) PCT Filed: Sep. 28, 2020

(86) PCT No.: PCT/EP2020/077024
§ 371 (c)(1),
(2) Date: Apr. 1, 2022

(87) PCT Pub. No.: WO2021/063848
PCT Pub. Date: Apr. 8, 2021

(65) Prior Publication Data

US 2022/0341239 A1 Oct. 27, 2022

(30) Foreign Application Priority Data

Oct. 1, 2019 (DE) ..... 10 2019 215 093.4

(51) Int. Cl.
*E05F 11/52* (2006.01)
*E05F 11/38* (2006.01)

(52) U.S. Cl.
CPC ..... *E05F 11/382* (2013.01); *E05Y 2201/684* (2013.01); *E05Y 2600/12* (2013.01)

(58) Field of Classification Search
CPC ..... E05F 11/382; E05Y 2201/684; E05Y 2600/12; E05Y 2600/322; E05Y 2600/528; B60J 1/17; B60J 5/04
(Continued)

(56) References Cited

U.S. PATENT DOCUMENTS 2,449,210 A * 9/1948 Faust ..... B60J 5/0402 49/374
2,955,816 A * 10/1960 Wise ..... E05F 11/405 464/88

(Continued)

FOREIGN PATENT DOCUMENTS

CN 1840846 A 10/2006
CN 103978871 A 8/2014

(Continued)

*Primary Examiner* — Jerry E Redman
(74) *Attorney, Agent, or Firm* — Laurence A. Greenberg; Werner H. Stemer; Ralph E. Locher

(57) ABSTRACT

A fastening device for a vehicle window lifter includes at least one guide rail for guiding a driver for a window glass or pane. A joint piece has two joint pins integrally formed axially opposite one another thereon along an axis of rotation, a fastening bolt, and a connection portion connected to the guide rail. The connection portion has a connection leg, with a through-opening for the fastening bolt, between two lateral legs having mutually aligned joint grooves for receiving the joint pins of the joint piece, which pivots between the lateral legs and is pivotably mounted in the connection portion. A vehicle window lifter for adjusting a window glass of a motor vehicle is also provided.

18 Claims, 7 Drawing Sheets

(58) Field of Classification Search
USPC ..... 49/212
See application file for complete search history.

(56) References Cited

U.S. PATENT DOCUMENTS

| | | | | | |
|---|---|---|---|---|---|
| 3,009,499 | A * | 11/1961 | Weihe | F16B 37/041 | 29/432 |
| 3,062,528 | A * | 11/1962 | Martens | E05F 11/405 | 49/227 |
| 3,228,677 | A * | 1/1966 | Martens | E05F 11/382 | 49/41 |
| 3,357,134 | A * | 12/1967 | Genord | B60J 5/0408 | 49/144 |
| 3,844,064 | A * | 10/1974 | Yamaha | B60J 1/17 | 49/227 |
| 4,761,915 | A * | 8/1988 | Marz | B60J 5/0468 | 49/374 |
| 4,956,942 | A * | 9/1990 | Lisak | E05F 11/382 | 49/502 |
| 5,430,976 | A * | 7/1995 | Wirsing | E05F 11/382 | 49/452 |
| 5,632,121 | A | 5/1997 | Handte et al. | | |
| 5,694,719 | A * | 12/1997 | Bejune | F16B 37/043 | 49/502 |
| 5,855,095 | A * | 1/1999 | Dedrich | B60J 5/0468 | 49/502 |
| 5,927,021 | A * | 7/1999 | Kowalski | B60J 5/0416 | 49/502 |
| 5,960,588 | A * | 10/1999 | Wurm | E05F 11/488 | 49/502 |
| 6,029,403 | A * | 2/2000 | Bertolini | B60J 5/0416 | 49/502 |
| 6,051,794 | A | 4/2000 | Katou et al. | | |
| 6,425,204 | B1 * | 7/2002 | Renner | E05F 11/382 | 49/213 |
| 6,425,208 | B1 * | 7/2002 | Klueger | E05F 11/382 | 49/502 |
| 6,453,617 | B1 | 9/2002 | Klippert et al. | | |
| 6,952,898 | B2 * | 10/2005 | Castellon | B60J 1/17 | 49/374 |
| 7,021,001 | B1 * | 4/2006 | Schooler | E05F 15/41 | 49/362 |
| 7,055,284 | B2 * | 6/2006 | Napoli | E05F 15/689 | 49/362 |
| 7,246,464 | B2 * | 7/2007 | Castellon | E05F 11/382 | 49/212 |
| 7,467,494 | B2 * | 12/2008 | Buchta | E05F 11/382 | 49/502 |
| 7,640,697 | B2 * | 1/2010 | Florentin | E05F 11/382 | 49/502 |
| 7,698,856 | B2 | 4/2010 | Tamaoki et al. | | |
| 7,743,559 | B2 * | 6/2010 | Papi | B60J 5/0416 | 49/502 |
| 7,836,634 | B2 * | 11/2010 | Bigourden | E05F 11/382 | 49/502 |
| 8,069,610 | B2 * | 12/2011 | Graf | E05F 11/382 | 49/212 |
| 8,127,493 | B2 * | 3/2012 | Cappelli | E05F 11/382 | 49/212 |
| 8,528,259 | B1 * | 9/2013 | Heirtzler | E05F 11/382 | 49/506 |
| 8,561,350 | B2 * | 10/2013 | Cardine | E05F 11/382 | 49/212 |
| 8,646,209 | B2 * | 2/2014 | Hampel | E05F 11/382 | 49/212 |
| 10,619,396 | B2 * | 4/2020 | Kapuskar | E05F 15/695 | |
| 11,319,742 | B2 * | 5/2022 | Bose | B60J 5/0416 | |
| 2003/0009948 | A1 * | 1/2003 | Nishikawa | E05F 11/485 | 49/502 |
| 2003/0131534 | A1 * | 7/2003 | Cardine | E05F 11/382 | 49/212 |
| 2004/0211122 | A1 | 10/2004 | Freymuth et al. | | |
| 2006/0254146 | A1 * | 11/2006 | Florentin | E05F 11/382 | 49/348 |
| 2008/0148647 | A1 * | 6/2008 | Pavlovic | E05F 11/382 | 49/502 |
| 2023/0137064 | A1 * | 5/2023 | Hirtsiefer | E05D 15/1042 | 49/127 |

FOREIGN PATENT DOCUMENTS

| | | | |
|---|---|---|---|
| DE | 4435008 | A1 | 4/1996 |
| DE | 19819953 | A1 | 11/1999 |
| DE | 202005010940 | U1 | 11/2006 |
| DE | 102008015121 | A1 | 10/2008 |
| JP | H10126944 | A | 5/1998 |
| KR | 20050108769 | A | 11/2005 |

* cited by examiner

FASTENING DEVICE FOR A WINDOW LIFTER, AND WINDOW LIFTER

FIELD AND BACKGROUND OF THE INVENTION

The invention relates to an in particular articulated fastening device for a window lifter (vehicle window lifter), having at least one guide rail for displaceably guiding a driver for a window glass. The invention furthermore relates to a window lifter (vehicle window lifter) for adjusting a window glass of a motor vehicle, having such a fastening device.

Movable vehicle window glass is usually moved between a closing position and an opening position by actuating devices which as (vehicle) window lifters are operated electrically or by electric motors. Such a window lifter typically comprises an (electric) actuating motor as well as an actuating mechanism which connects the actuating motor to the window glass, meaning that the actuating motor is operatively coupled to the window glass for the transmission of force, said actuating mechanism being assigned to a motor vehicle door or a motor vehicle body. The actuating mechanism here is mechanically linked to the window glass to be moved by means of at least one driver (rail slide), for example.

Drivers or rail slides of this type as glass guiding elements are typically disposed in the region of a lower edge of the window glass and there connected to the latter. For example, such a driver is connected to the (electric) actuating motor by way of a flexible traction means of the actuating mechanism, for example in the form of a cable pull (traction cable) and adjustable along the guide rail so as to move the window glass along the adjustment path between the closing position and the opening position.

In order for the vehicle interior to be reliably closed in the closing position, the window glass on the periphery is guided toward a seal of the vehicle door. In particular in the case of vehicle doors having a so-called flush or frameless glass concept (flush glass, flush glazing) in which the glass surface of the window glass is embodied so as to be substantially flush or planar with the surrounding surfaces of the doorframe and/or vehicle frame, the issue can arise that the window glass in the closing position has a comparatively low contact pressure or sealing pressure in the region of the upper glass edge. As a result of the reduced contact pressure of the window glass on the seal, damage in the interior of the vehicle can be caused by virtue of external influences, in particular moisture and/or dirt. Furthermore, undesirable wind noise can arise as a result of the reduced contact pressure of the window glass on the seal.

In order to cause a safe and reliable sealing pressure, preloading of the glass, thus mechanical preloading of the window glass, is typically generated. The preloading of the glass here is caused by the guide of the driver, for example, this however having the disadvantage that the driver by virtue of the large lever arm between the upper edge of the glass and the attachment of the driver to the lower glass edge has to be embodied in a comparatively robust manner. According to DE 198 19 953 A1, for example, it is alternatively possible for the window glass to be attached to the window lifter by means of an adjustable driver, or for the preloading of the glass to be generated by the glass geometry. However, the intensity of the preloading here is limited by the geometric variability of the window glass area.

Known from DE 44 35 008 A1 is an adjustment device for a door window glass of a motor vehicle which has a frameless configuration and interacts with a window lifter assembly, wherein the guide rails are embodied so as to be pivotable in the vehicle transverse direction (Y-direction) about a rotation axis which lies in the upper fastening point of said guide rails. The adjustment of the inclination of the window lifter assembly here by way of an adjustment installation having a displacement guide takes place at the lower end of the guide rails.

A fastening or adjustment device for guide rails of window lifters in motor vehicles is known from DE 10 2008 015 121 A1, in which a fastening part which is able to be connected to the vehicle door and an attachment portion which is operatively connected to the guide rail mutually engage so as to form a pivot joint. The fastening part has a threaded shank which penetrates a bore in the guide rail, and has a bore or pin portions which, subsequent to the fastening part being positioned on the guide rail, by forming the attachment portion of said guide rail conjointly with said attachment portion form the bearing point of the pivot joint.

SUMMARY OF THE INVENTION

The invention is based on the object of specifying a particularly suitable fastening device for a window lifter (vehicle window lifter), in particular for assembling a guide rail in an articulated manner on a frame part or module part (sheet-metal part, sheet-metal frame, door module) of a vehicle door. In particular, the preferably articulated fastening device is to have as few individual parts as possible. Moreover, the fastening device is to be able to be attached in an articulated manner (in a bending-free manner) to an attachment portion of the guide rail, or to the guide rail, without bending an attachment portion of the guide rail. The invention is furthermore based on the object of specifying a particularly suitable window lifter (vehicle window lifter) for adjusting a window glass of a motor vehicle having such a fastening device.

In terms of the fastening device, the object is achieved according to the invention by the features of the claims, and in terms of the vehicle window lifter by the features of the claims. Advantageous design embodiments and refinements are the subject matter of the dependent claims. The advantages and preferred design embodiments set forth in the context of the fastening device can also be applied in an analogous manner to the vehicle window lifter and vice versa.

The fastening device for a window lifter (vehicle window lifter), having at least one guide rail for displaceably guiding a driver for a window glass, has a joint piece having two joint pins which are axially mutually opposite along a rotation axis. These joint pins are integrally molded on a main body of the joint piece. Furthermore, the fastening device has a fastening bolt. Furthermore, the fastening device has an attachment portion which is connected to the guide rail and between two lateral legs has a connection leg (central leg) having a through opening for the fastening bolt. These two lateral legs in turn have mutually aligned joint grooves for receiving the joint pin of the joint piece. This joint piece, or the main body thereof, respectively, in the direction of the central leg is pivotable (able to swivel) between the lateral legs, and in the inward-pivoted state is pivotably mounted in the attachment portion.

In a first variant, the joint piece, or the main body thereof, respectively, has an opening, preferably a through opening. The fastening bolt has a first shank portion which is insertable, or inserted, in the opening of the joint piece, and has a second shank portion.

A variant of the fastening device for a window lifter (vehicle window lifter), having at least one guide rail for displaceably guiding a driver for a window glass, has a joint piece having two joint pins which are integrally molded on said joint piece so as to be axially mutually opposite along a rotation axis, as well as a fastening bolt having a first shank portion integrated in the main body of the joint piece, and having a second shank portion. An attachment portion which is connected to the guide rail in turn between the lateral legs has the connection leg which has the through opening for the fastening bolt, said lateral legs having the mutually aligned joint grooves for receiving the joint pin of the joint piece, so as to pivot the latter, or the main body thereof, respectively, in the direction of the central leg between the lateral legs and so as to pivotably mount said joint piece, or the main body thereof, respectively, in the attachment portion.

The attachment portion is preferably an integral component part of the guide rail (in one piece with the latter). The mutually aligned joint grooves of the two lateral legs in the assembled state of the window lifter, or of the guide rail thereof, respectively, here are suitably open toward the top such that the joint pins of the joint piece at the upper rail end of the guide rail are able to be inserted in the attachment portion of said guide rail there.

In an advantageous design embodiment, the joint pins of the joint piece and the joint grooves of the attachment portion of the guide rail form a pivot joint. In order for this pivot joint to be produced or formed, respectively, the joint piece is joined to the attachment portion of the guide rail. This joint connection is preferably formed in that the joint pins of the joint piece have two mutually opposite (planar) flat sides as guide faces. Correspondingly, the joint grooves of the attachment portion expediently have a constriction which in the groove longitudinal direction joins an introduction portion in the region of a groove opening, and adjoining thereto a groove portion in the manner of a joint socket for receiving the respective joint pin of the joint piece. The available width between the groove flanks of the respective joint groove at the position of the constriction corresponds to the thickness or the width of the joint pins in the region between the flat sides. In this way, joint pins of the joint piece in a corresponding orientation can be introduced into the joint-socket type groove portions of the joint grooves.

The joint pins of the joint piece furthermore have two mutually opposite, in particular radiused, preferably arcuate, joint sides as joint faces. The respective joint groove preferably has a groove portion in the manner of a joint socket which adjoins the introduction portion. This groove portion service for receiving the respective joint pin and thus as a counterbearing for the corresponding joint pin of the joint piece.

In this way, the joint piece, which in a corresponding orientation by way of the joint pins thereof has been introduced into the joint grooves up to the joint-socket type groove portion, can be rotated at this location in order for the joint piece in the direction of the central leg of the attachment portion to be pivoted between the lateral legs. To this end, the joint-socket type groove portion of the respective joint groove is advantageously arcuate, wherein the arc of the groove portion extends across an angle of more than 180° and preferably 270° or less. In this way, the joint pins of the joint piece, in the course of the latter being pivoted, while overcoming a friction force which is defined or determined, respectively, by the geometry of the groove and the pin, latch into the joint-socket type groove portions of the joint grooves. As a result, a captive fit of the joint piece that is pivoted inward between the legs of the attachment region is ensured.

The main body of the joint piece may have different basic shapes. However, the main body is preferably embodied so as to save as much material as possible such that the weight of the joint piece is ideally low. To this end, the main body of the joint piece is expediently cylindrical, and the joint pins are provided on the end side of a joint web which is integrally molded on the shell of the main body and runs tangentially thereto. The joint piece is suitably composed of plastics material. This additionally achieves decoupling, reduction in play, and/or optimization in terms of noise.

In an expedient refinement, a detent periphery is integrally molded on at least one of the joint pins, preferably on both joint pins. This detent periphery serves for the joint piece bearing on at least one of the groove legs of the corresponding joint groove.

In a further design embodiment, the opening of the joint piece is embodied as a through opening having an internal thread. In a manner corresponding thereto, the first shank portion of the fastening bolt has an external thread. A tool opening at the end side in the fastening bolt enables the fastening bolt to be screwed into the opening of the joint piece, or the main body of the latter, respectively. Alternatively, the fastening bolt can be embodied so as to have a threadless first shank portion, and the mounting of the fastening bolt in the opening of the joint piece can be established by way of a materially integral connection (for example by means of Tuflok).

A further design embodiment of the fastening bolt provides that at least one annular detent is provided between the first and the second shank portion of said fastening bolt. This annular detent or a further annular detent serves for bearing on the joint piece, as a result of which the penetration depth of the fastening bolt, or of the first shank portion thereof, respectively, into the opening of the joint piece is delimited in a targeted manner and is thus adjusted in a defined manner. Moreover, the annular detent serves for bearing on a frame part or module part, in particular a vehicle door, while the second shank portion of the fastening bolt penetrates a through opening in the frame part or module part so as to therein receive a screw nut.

This annular detent, which is preferably integrally molded on the fastening bolt, suitably also serves as a detent on the opening periphery of the through opening of the attachment portion, so as to delimit the or a pivoting movement of the joint piece.

In an advantageous design embodiment, the joint pins are embodied as eccentrics. The latter are preferably embodied as a material application of or to the joint pins. The eccentricity of the joint pins enables the joint piece to be mounted without play on the guide rail 2, or on the attachment portion of the latter, respectively. Moreover, the eccentrics lead to noise being minimized on or in the bearing point.

The vehicle window lifter according to the invention for adjusting a window glass of a motor vehicle has at least one guide rail, preferably two mutually parallel guide rails, and the fastening device having an attachment portion at the rail-proximal end side. An adjustment or setting installation, for example in the form of a threaded bolt, is suitably provided on the rail end opposite the attachment portion. With said threaded bolt, the respective guide rail can be adjusted in the vehicle transverse direction (Y-direction) and to this end be pivoted about the upper pivot joint of the fastening device. The maximum adjustment stroke here is preferably delimited by the pivot stroke of the joint piece, the latter in turn being determined by the spacing (pivot arc) of the annular detent of the fastening bolt from the attachment portion of the guide rail.

Exemplary embodiments of the invention are explained in more detail hereunder by means of a drawing.

DETAILED DESCRIPTION OF THE INVENTION

Equivalent parts and variables are always provided with the same reference signs in all figures.

Figure 1:
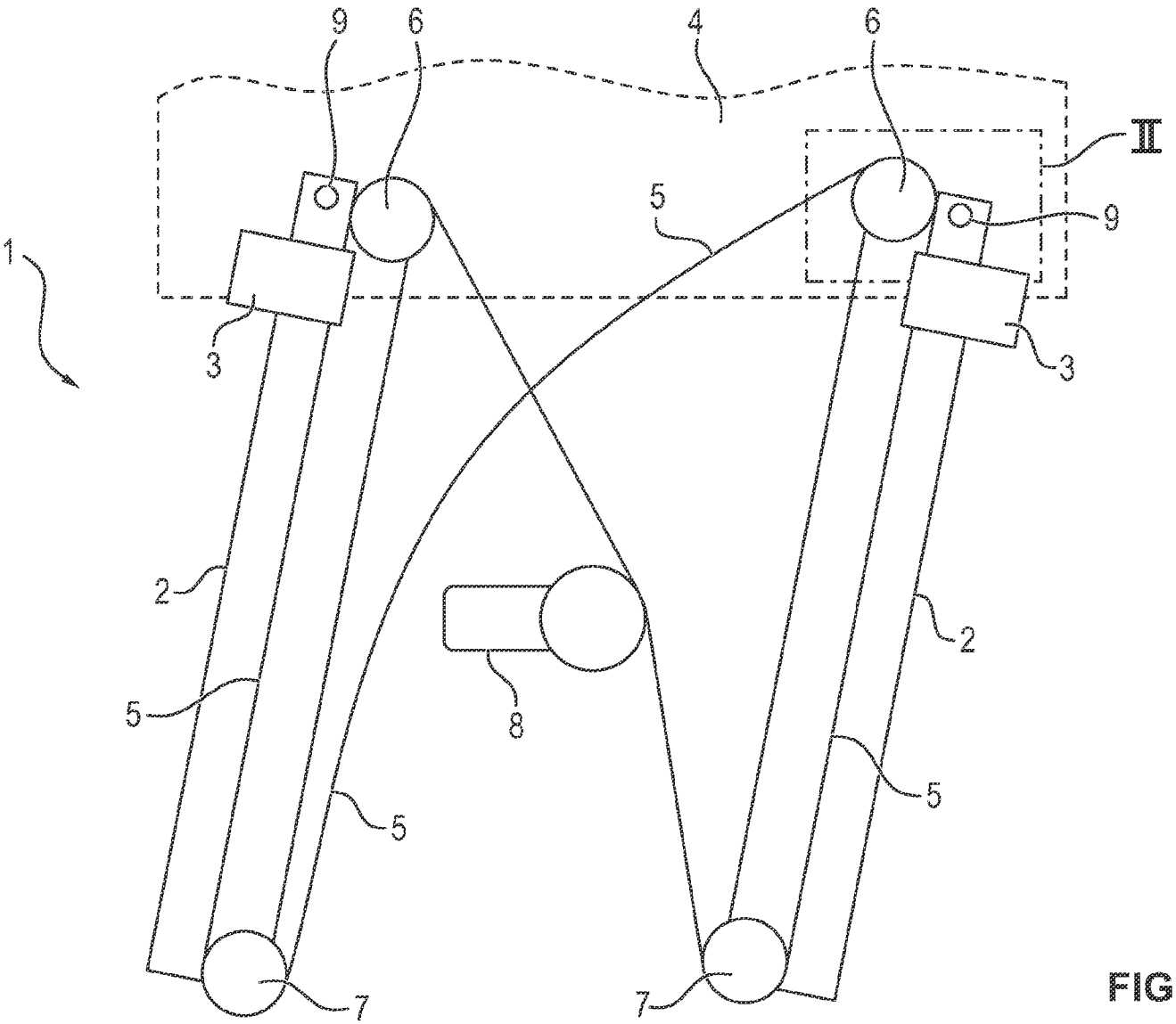
FIG. 1 in a perspective illustration shows a vehicle window lifter having an actuating motor and having an actuating mechanism, as well as having two guide rails having in each case one articulated fastening device.

FIG. 1 shows a window lifter 1 for a motor vehicle (vehicle window lifter), in the exemplary embodiment a so-called dual-strand cable window lifter, having two parallel guide rails 2 on which drivers (rail slides) 3 are displaceably guided. A window glass 4 is held, for example fixed by jamming, on the drivers 3. The drivers 3 are connected to a cable pull 5 which is guided over upper and lower deflection rollers 6 and 7, respectively, and coupled to a cable drive 8 with an electric motor. A rotating movement of the electric-motor cable drive 8 leads to the window glass 4 being moved to an opening position or, in the opposite direction, to a closing position of the window glass 4.

It is necessary or desirable, in particular in the case of a frameless vehicle door, that an upper glass portion or an upper glass edge of the window glass 4 bears on a seal (on the vehicle roof) by way of a certain or determined contact pressure. In order for this to be achieved, a pivotable fastening device 9 is provided on at least one of the guide rails 2, preferably on each of the guide rails 2, at the upper rail end of the latter.

Indications in terms of the spatial directions hereunder are stated in a coordinate system of the motor vehicle (vehicle coordinate system). The abscissa axis (X-axis) here is oriented along the vehicle longitudinal direction (direction of travel), and the ordinate axis (Y-axis) is oriented along the vehicle transverse direction, and the applicate axis (Z-axis) is oriented along the vehicle height.

Figure 2:
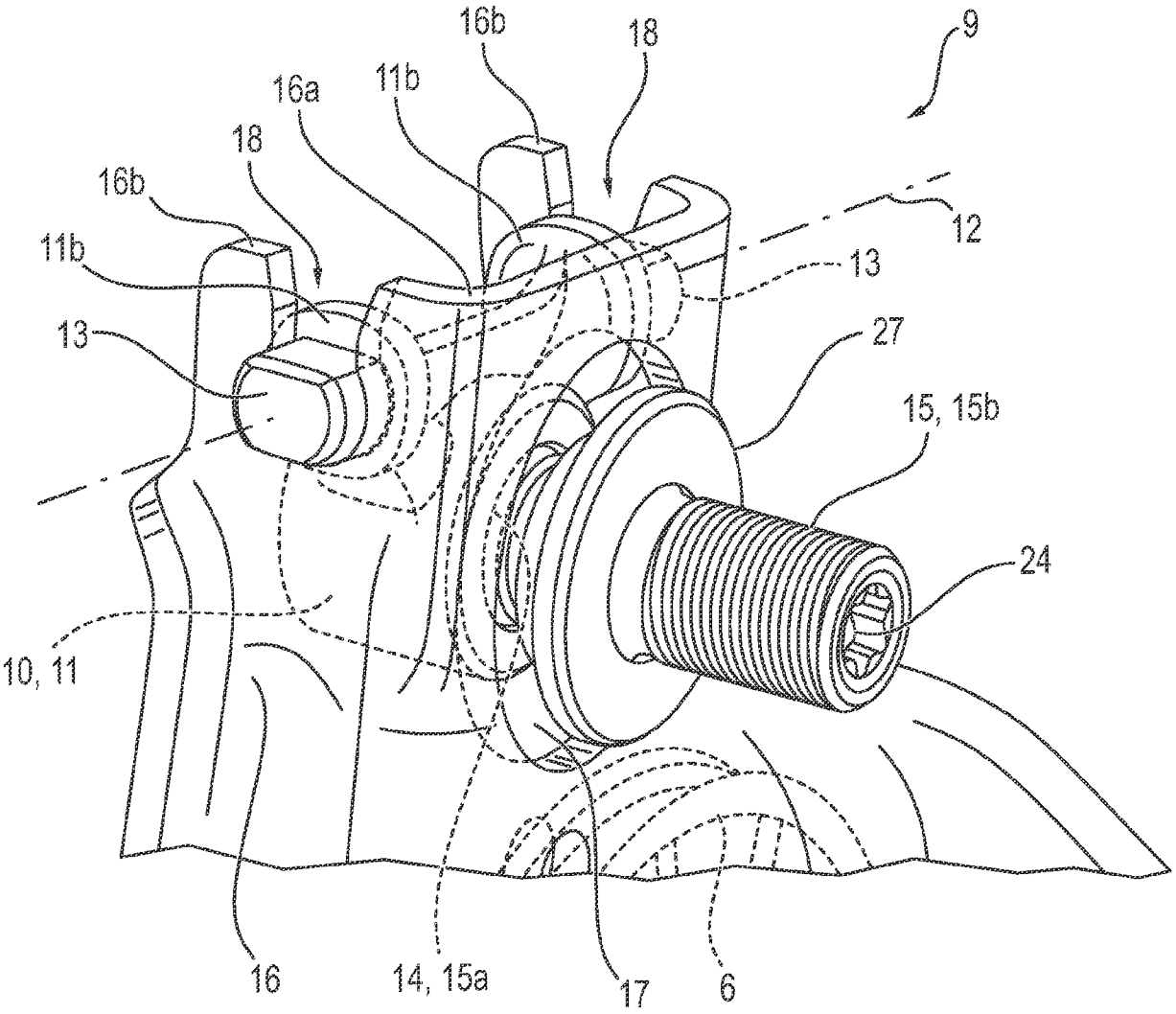
FIG. 2 in a perspective manner shows a fragment II from FIG. 1 in a larger scale, having an (upper) attachment portion of one of the guide rails and pivotably mounted thereon a joint piece having an inserted fastening bolt.

FIG. 2 shows a perspective fragment of the fastening device 9 for the window lifter 1, having the at least one guide rail 2. The fastening device 9 has a joint piece 10 having a main body 11 on which two joint pins 13 that are axially mutually opposite along a rotation axis 12 are integrally molded. The joint piece 10, or the main body 11 thereof, respectively, in the exemplary embodiment has an opening 14 as a through opening.

The fastening device 9 furthermore has a fastening bolt 15 which has a first shank portion 15*a* that is insertable, or inserted, in the opening 14 of the joint piece 10, and has a second shank portion 15*b*. Furthermore, the fastening device 9 has an attachment portion 16 which is connected to the guide rail 2. This attachment portion 16 is preferably an integral component part of the guide rail 2 (in one piece with the latter). The attachment portion 16 in the cross section is U-shaped and comprises a connection leg 16*a* and two lateral legs 16*b*. A through opening 17 which is aligned with the opening 14 of the joint piece 10 is incorporated in the connection leg 16*a*.

The lateral legs 16*b* have mutually aligned joint grooves 18 for receiving the joint pin 13 of the joint piece 10. The main body 11 of the latter in the direction of the connection leg 16*a* is pivotable between the lateral legs 16*b*, and in the inward-pivoted state is mounted in the attachment portion 16 so as to be pivotable about the rotation axis 12. The mutually aligned joint grooves 18 of the two lateral legs 16*b* in the assembled state of the window lifter 1, or of the guide rails 2 thereof, respectively, here are open at the top such that the joint pins 13 of the joint piece 10 are able to be inserted into the attachment portion 16 of the guide rail 2 at the upper rail end, as will be described in more detail hereunder by means of FIGS. 7*a* to 7*d*. The joint pins 13 of the joint piece 10 and the joint grooves 18 of the attachment portion 16 of the guide rail 2 form a pivot joint.

Figure 3:
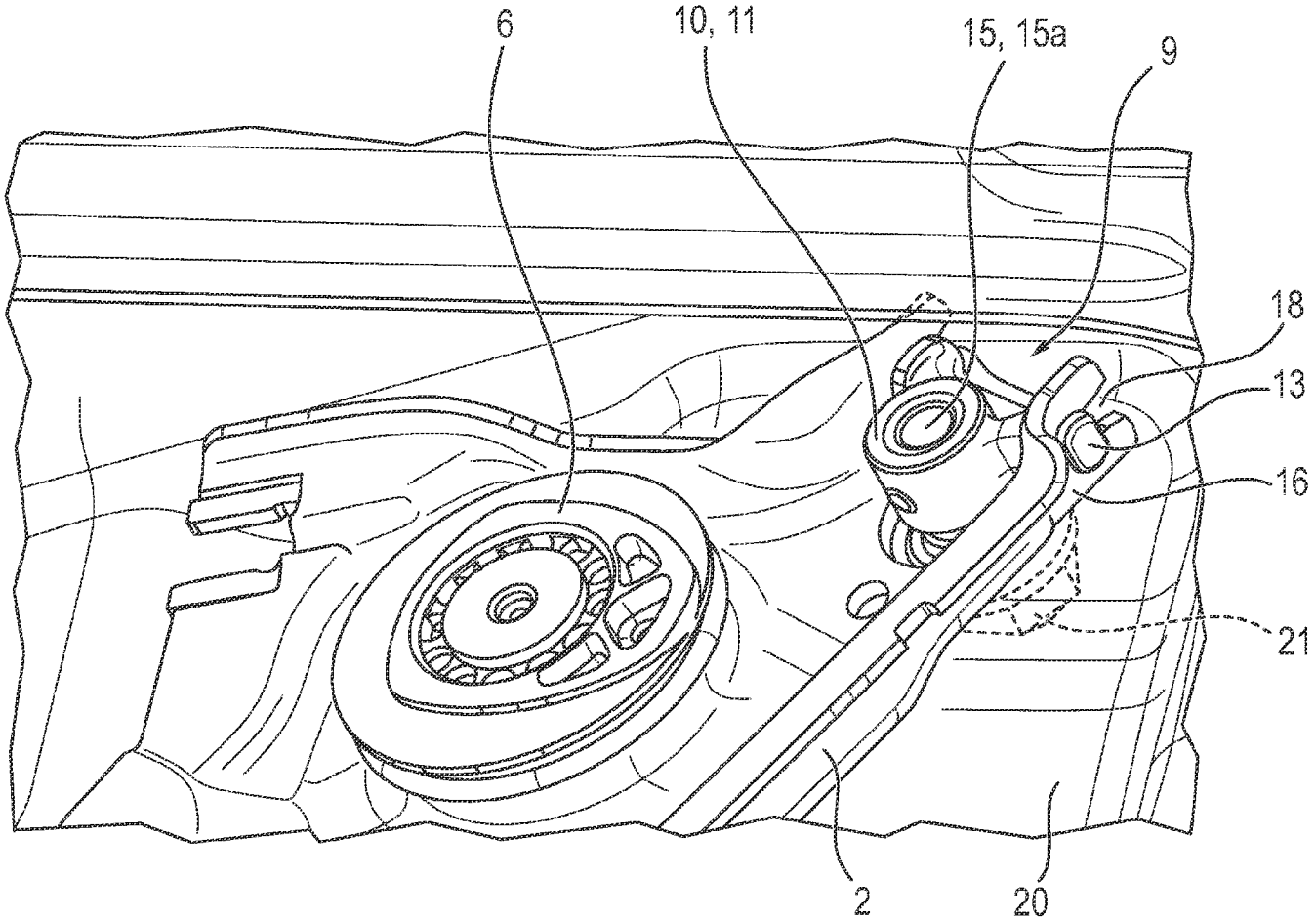
FIG. 3 in a perspective illustration shows a fragment from FIG. 1 having a transparently shown frame part or module part, and the fastening device attached (or connected, respectively) thereto.
Figure 4:
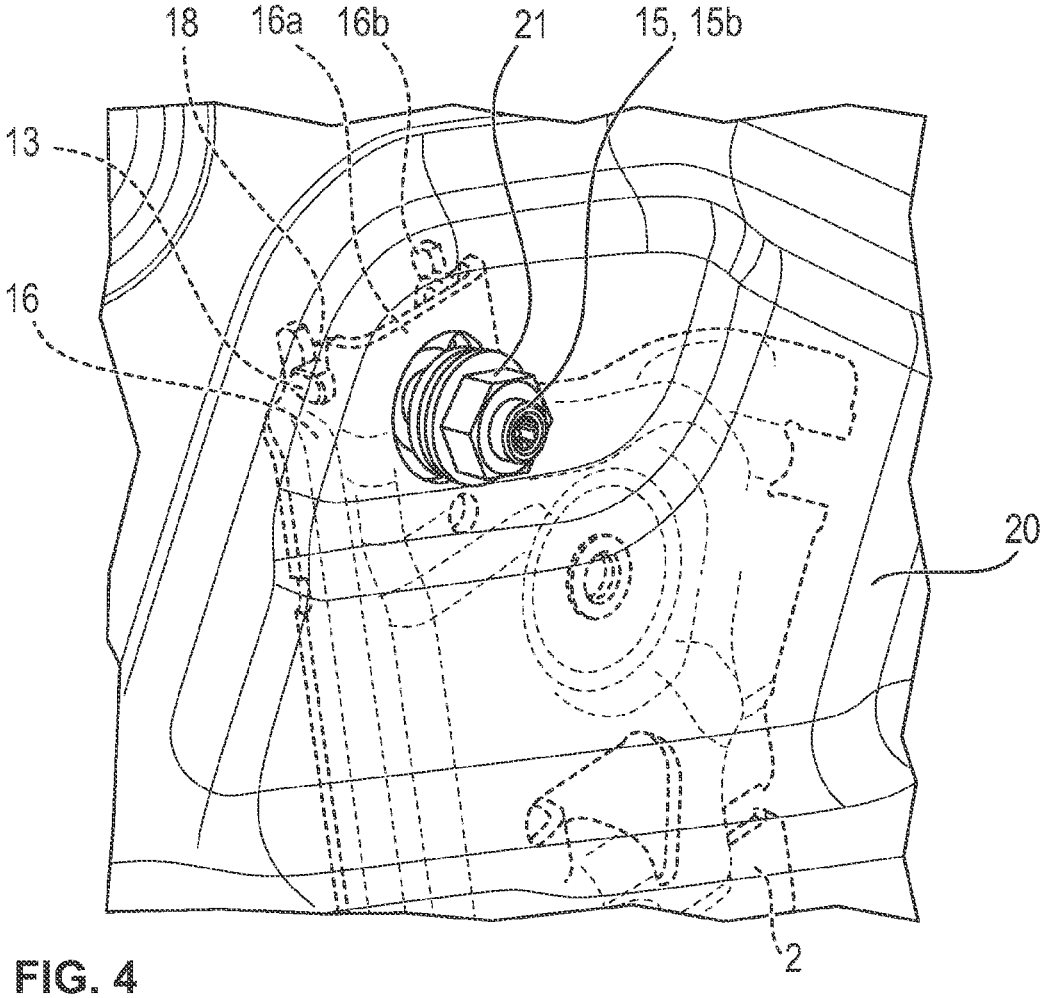
FIG. 4 shows the assembly according to FIG. 3 in a rear view onto a screw fastening of the guide rail, or the attachment portion thereof of the transparently shown frame part or module part.

FIGS. 3 and 4 in a perspective illustration show in fragments the fastening device 9 in a transparently shown frame part or module part 20, in particular a vehicle door, in a front view, or in a rear view, respectively, on to a screw fastening of the guide rail 2, or the attachment portion 16 thereof on the frame part or module part 20 by means of a screw nut 21.

Figure 5:
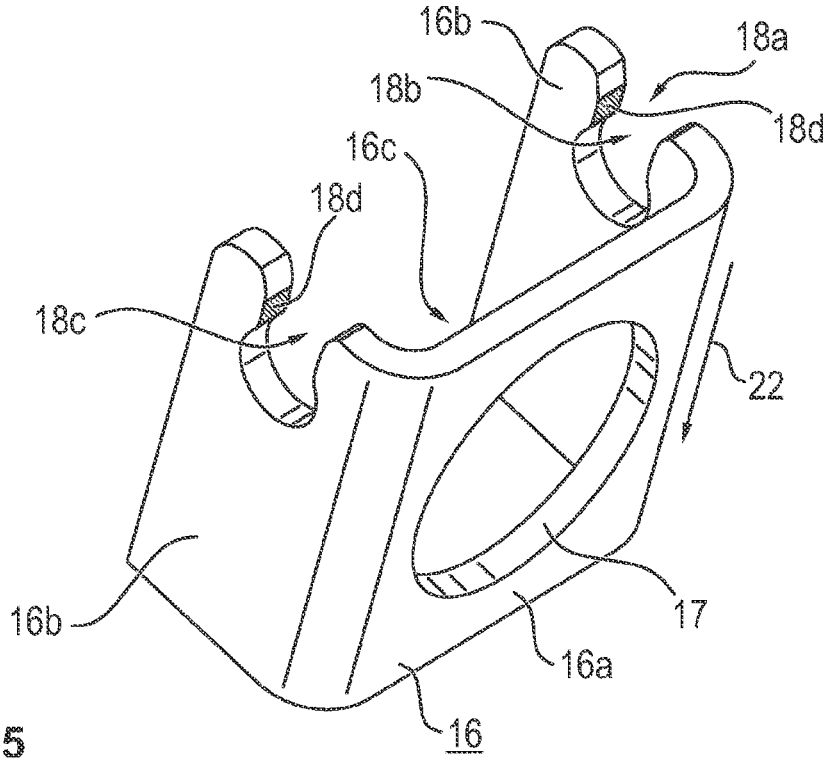
FIG. 5 in a perspective illustration shows the (U-shaped) attachment portion of the guide rail having a through opening in a connection leg between mutually spaced apart legs, having joint grooves incorporated therein.
Figure 7A:
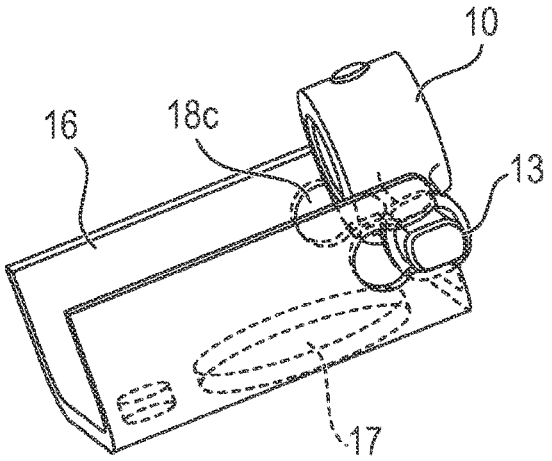
FIGS. 7*a*-7*d* show in a perspective view in four joined positions the joint piece inserted and pivoted into the joint grooves.
Figure 7B:
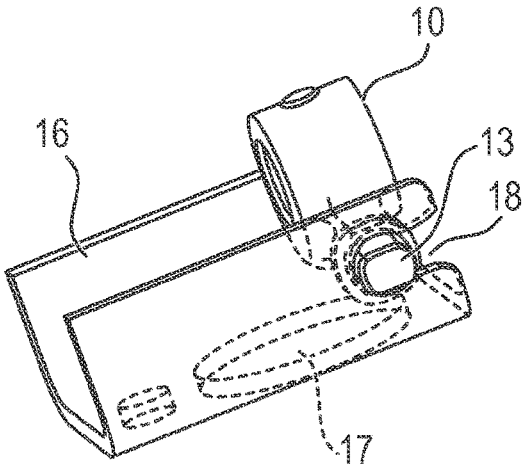
Figure 7C:
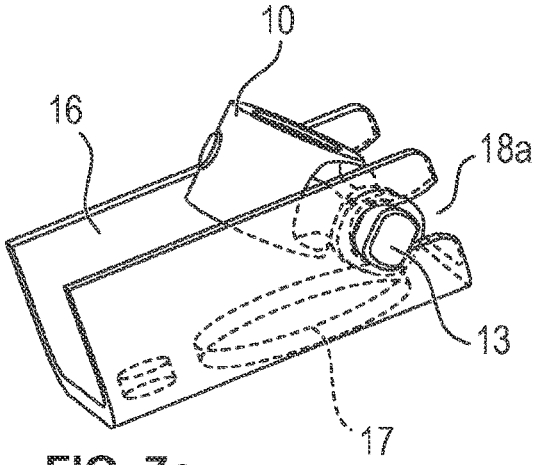

FIG. 5 shows in a perspective view the U-shaped attachment portion 16 at the upper rail end of the guide rail 2, having the through opening 17 in the connection leg 16*a* between the mutually spaced apart legs 16*b*, having the joint grooves 18 incorporated therein. These joint grooves 18 have a conical introduction portion 18*a* which in the groove longitudinal direction 22 opens into a constriction 18*b* which is adjoined by a joint-socket type groove portion 22*c*. The latter is arcuate and forms the location of the joint (the counter bearing) for the respective joint pin 13. The respective constriction 18*b* forms friction faces (friction edges) 18*d* along which the respective joint pin 13, while overcoming a specific friction force when overstressing the respective constriction 18*b*, is pivoted into the groove portion 22*c* (FIGS. 7*a* to 7*b*). A receptacle space 16*c* which is open on one side and into which the joint piece 10 pivots is situated between the legs 16*b* of the attachment portion 16.

Figure 6:
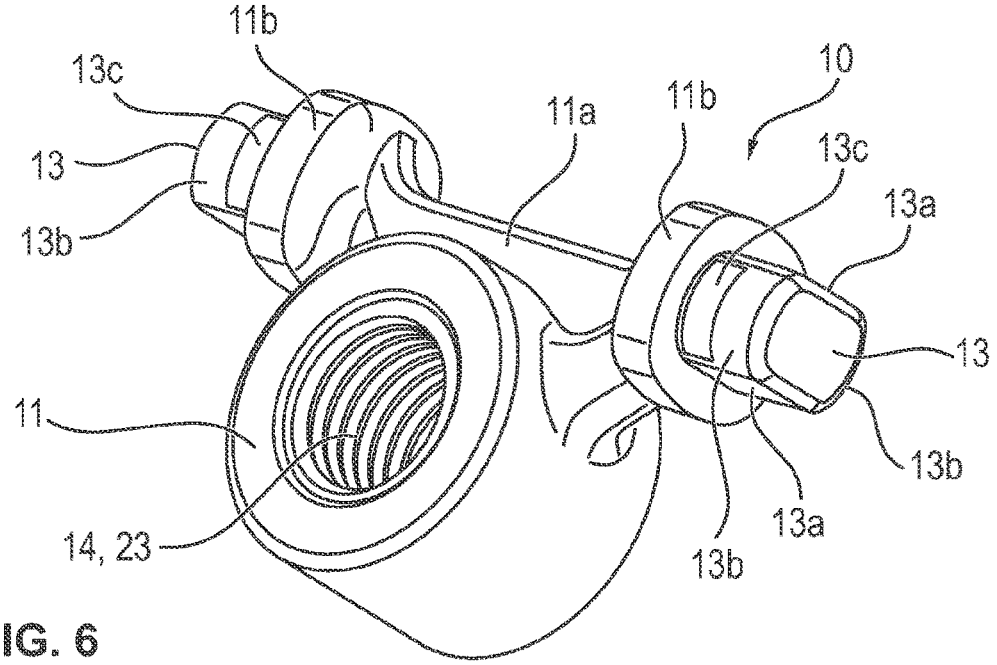
FIG. 6 in a perspective illustration shows the joint piece in a preferred embodiment, having joint pins integrally molded thereon.

FIG. 6 shows in a perspective view the joint piece 10 in a preferred embodiment. The joint piece 10 has a cylindrical main body 11. The joint pins 13 are provided on the end side of a joint web 11*a* which is integrally molded on the shell of the main body 11 and runs tangentially thereto. As a result, the main body 10, which is preferably composed of plastics material, is embodied in a particularly material-saving and lightweight manner. The joint pins 13 of the joint piece 10 have two mutually opposite flat sides 13*a* as guide faces. The mutual spacing thereof corresponds to the available width at the constriction 18*b* between the groove flanks of the respective joint groove 18. In other words, the thickness between the flat sides 13*a* of the respective joint pin 13 corresponds to the width of the joint groove 18 at the constriction 18*b* of the latter. In this way, the joint pins 13 can be introduced into the joint grooves 18. Furthermore, the joint pins 13 of the joint piece 10 have two mutually opposite, radiused, in particular arcuate, joint sides 13*b* as joint faces or sliding faces.

Figure 8:
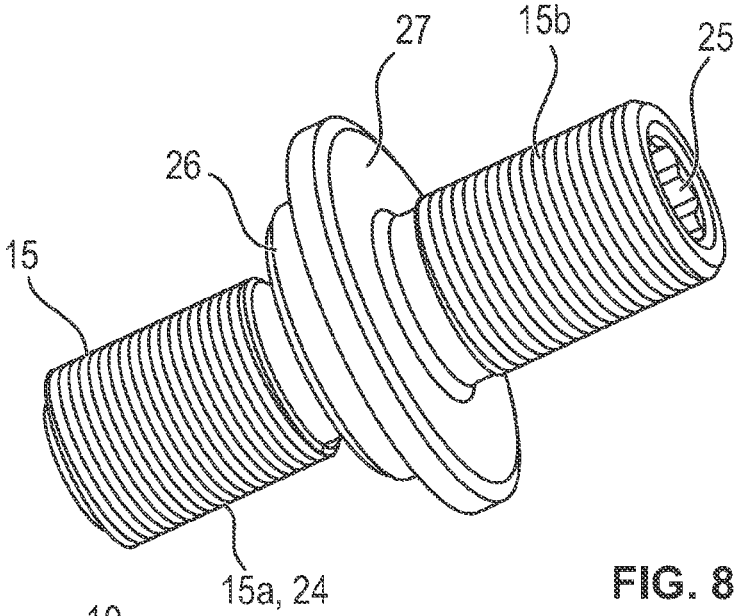
FIG. 8 in a perspective illustration shows the fastening bolt having two shank portions and two disk-type, collar-type or shoulder-type bearing faces in the form of annular bearing or detent peripheries fixed to the joint piece (integrally molded on the joint piece or the main body thereof, respectively)

A detent periphery 11*b* is integrally molded on the joint pins 13. This detent periphery 11*b* serves for bearing the joint piece 10 on the groove legs of the corresponding joint groove 18. The opening 14 of the joint piece 10 is embodied as a through opening having an internal thread 23. In a manner corresponding thereto, the first shank portion 15*a* of the fastening bolt 15 has an external thread 24 (FIG. 8). A tool opening 25 on the end side in the fastening bolt 15 serves for receiving a tool for screwing the fastening bolt 15 into the opening 14 of the joint piece 10, or the main body 11 of the latter, respectively.

As can be seen from FIG. 8, a first annular detent 26 is provided between the two shank portions 15*a* and 15*b* of the fastening bolt 15. This annular detent 26 serves for bearing on the joint piece 10, as a result of which the penetration depth of the first shank portion 15*a* of the fastening bolt 15 into the screw opening 14 of the joint piece 10 is delimited. A second annular detent 27 is provided between the two shank portions 15*a* and 15*b* of the fastening bolt 15. The diameter of said second annular detent 27 is larger than that of the first annular detent 26. The second annular detent 27 serves for bearing on the frame part or module part 20 (FIG. 4), while the second shank portion 15*b* of the fastening bolt 15 penetrates a through opening 28 in the frame part or module part 20 so as to receive the screw nut 21 therein. This second annular detent 27 also serves as a detent on the opening periphery of the through opening 17 of the attachment portion 16 so as to delimit the pivot path of the joint piece 10.

It can be seen from the sequence of the four joined positions shown in FIGS. 7*a* to 7*d* how the joint piece 10 is joined to the attachment portion 16 of the guide rail 2 so as to produce, or form, respectively, the pivot joint. According to FIG. 7*a*, the joint piece 10 is inserted by way of the respective introduction portion 18*a* in such an orientation of the joint pins 13 in relation to the joint grooves 18 of the attachment portion 16 that the flat sides 13*a* pass the constriction 18*b* and the joint pins 13 can be introduced into the joint-socket type groove portion 18*c*. This joined position is shown in FIG. 7*b*.

Figure 7D:
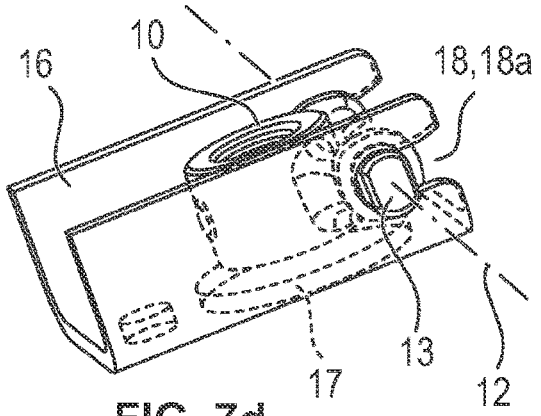

At this position, the joint piece 10 that in the corresponding orientation has been introduced into the joint grooves 18 up to the groove portion 18*c* can be pushed in by a rotating movement (FIG. 7*c*) and pivoted into the receptacle space 16*c* between the lateral legs 16*b* and in the direction of the connection leg 16*a* of the connection portion 16 (FIG. 7*d*). The joint piece 10 therein is held so as to be rotatable about the rotation axis 12.

To this end, the joint-socket type groove portion 18*c* of the respective joint groove 18 is arcuate, wherein the arc of the groove portion 18*c* extends across an angle of more than 180° and preferably less than 270°. In this way, the quasi over-stressed joint pins 13 of the joint piece 10 in the process of the pivoting of the latter, while overcoming the friction force predefined by the geometry of the groove and the pin, latch into the joint-socket type groove portions 18*c* of the joint grooves 18. As a result, a captive fit of the joint piece 10 pivoted inward between the legs 16*b* of the attachment region 16 is ensured.

The joint pins 13 are embodied as eccentrics. The latter are embodied as material application 13*c* of or to the joint pins 13. Material applications 13*c* of this type here are suitably provided on both radiused joint sides 13*b* of both joint pins 13. The eccentricity of the joint pins 13 enables the joint piece 10 to be mounted without play on the guide rail 2, or on the attachment portion 16 thereof in the assembly position shown in FIG. 7*d*. Moreover, the eccentrics lead to noise being minimized on or in the bearing point, i.e. in the (mechanical) interface between the guide rail 2, or of the attachment portion 16 thereof, respectively, and the joint pins (joint bolts) 13. Furthermore, the joint piece 10 including the joint pins 13 is held in a defined position by virtue of the increased friction. This is advantageous with a view to further assembling as well as when transporting the window lifter functional group as a door module conjointly with the frame part (support body) 20, the guide rails 2, the drivers 3, the cable pull 5 and the electric-motor cable drive 8.

Figure 9:
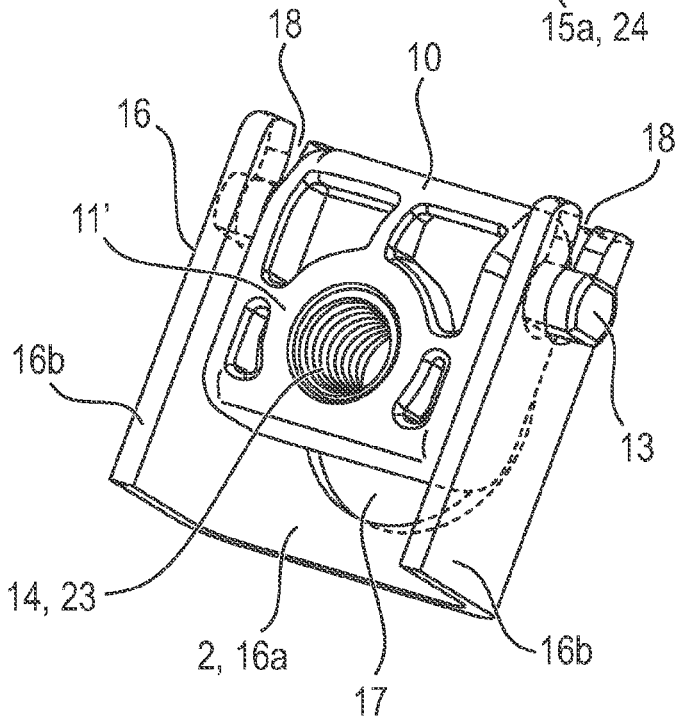
FIGS. 9 and 10 in a perspective illustration show the fastening device having two further geometric variants of the joint piece.
Figure 10:
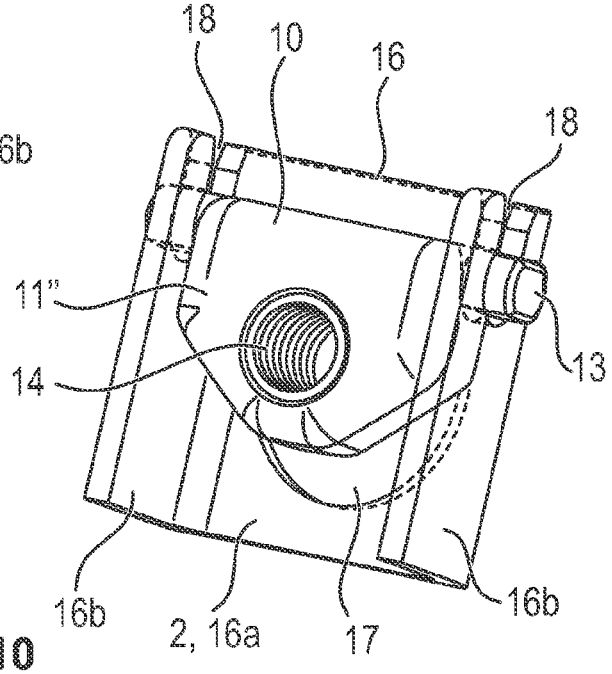

FIGS. 9 and 10 in a perspective manner show the fastening device 9 having two further geometric variants of the main bodies 11' and 11", respectively, of the joint piece 10. In the embodiment according to FIG. 10 the opening 14 of the joint piece 10 is embodied without an internal thread. In this embodiment, the fastening bolt 15 by way of the first shank portion 15*a* thereof, which in this instance is likewise threadless, is fixed in a materially integral manner in the opening 14, for example by means of an adhesive (Tuflok).

Figure 11:
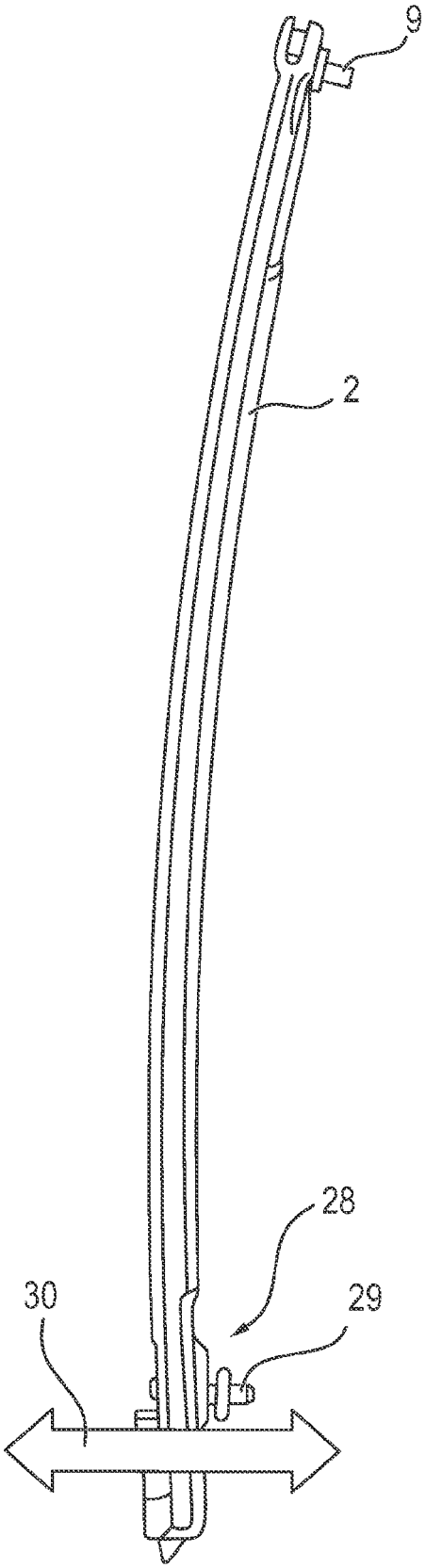
FIG. 11 shows one of the guide rails in a lateral view, having an adjustment or setting installation at the lower rail end.

FIG. 11 shows one of the guide rails 2 in a lateral view, having an adjustment installation 28 at the lower rail end opposite the attachment portion 16. The adjustment installation 28 has a threaded bolt 29 by means of which the respective guide rail 2, as is visualized by the double arrow 30, can be adjusted in the vehicle transverse direction (Y-direction) and to this end can be pivoted about the rotation axis 12 of the fastening device 9 embodied as a pivot joint. The maximum adjustment stroke here is delimited by the pivot stroke of the joint piece 10, the latter in turn being determined by the spacing (arcuate portion) of the annular detent 27 of the fastening bolt 9 from the attachment portion 16 of the guide rail 2.

The claimed invention is not restricted to the exemplary embodiments described above. It is rather also possible for other variants of the invention to be derived therefrom within the scope of the disclosed claims by a person skilled in the art, without departing from the subject matter of the claimed invention. In particular, all individual features described in conjunction with the various exemplary embodiments may furthermore also be combined with one another in some other way within the scope of the disclosed claims, without departing from the subject matter of the claimed invention.

For instance, the fastening bolt 15 can be integrally molded on the joint piece 10 in such a manner that the first shank portion of said fastening bolt 15 is an integral component part of the joint piece 10, or of the main body 11 of the latter, respectively.

Such a fastening device 9 for a window lifter (vehicle window lifter) 1, having at least one guide rail 2 for displaceably guiding a driver 3 for a window glass 4, has a joint piece 10 having two joint pins 13 which are integrally molded on said joint piece 10 so as to be axially mutually opposite along a rotation axis 12, as well as a fastening bolt 15 having a first shank portion 15*a* which is integrated in the main body 11 of the joint piece 10, and having a second shank portion 15*b*, wherein an attachment portion 16 which is connected to the guide rail 2 between two lateral legs 16*b* has a connection leg 16*a* having a through opening 17 for the fastening bolt 15, said two lateral legs 16*b* having mutually aligned joint grooves 18 for receiving the joint pin 13 of the joint piece 10 so as to pivotably mount said joint pin 13 between the lateral legs 16*b*.

Moreover, the solution described cannot only be used in the specifically illustrated application but in a similar embodiment also in other motor vehicle applications, such as, for example, in door and tailgate systems, in single-strand window lifters, in vehicle locks, in adjustable seat and interior systems, as well as in electric drives, control systems, sensors and the disposal of the latter in the vehicle.

LIST OF REFERENCE SIGNS

1 Window lifter
2 Guide rail
3 Driver
4 Window glass
5 Cable pull
6 Upper deflection roller
7 Lower deflection roller
8 Cable drive
9 Fastening device
10 Joint piece
11 Main body
11*a* Joint web
11*b* Detent periphery
12 Rotation axis
13 Joint pin
13*a* Flat side/guide face
13*b* Radiused joint side/joint face
14 Through opening/opening
15 Fastening bolt
15*a* First shank portion
15*b* Second shank portion
16 Attachment portion
16*a* Connection leg
16*b* Leg
16*c* Receptacle space
17 Through opening
18 Joint groove
18*a* Introduction portion
18*b* Constriction
18*c* Groove portion
18*d* Friction face
19 Rotation axis
20 Frame part/module part
21 Screw nut
22 Groove longitudinal direction
23 Internal thread
24 External thread
25 Tool opening
26 First annular detent
27 Second annular detent
28 Adjustment installation
29 Threaded bolt
30 Double arrow/pivoting direction

The invention claimed is:

1. A fastening device for a vehicle window lifter having at least one guide rail for displaceably guiding a driver for a window glass, the fastening device comprising:

a joint piece having a main body with an opening formed therein, said joint piece having two joint pins integrally molded on said main body and disposed mutually opposite axially along a rotation axis;

a fastening bolt having first and second shank portions, said first shank portion being insertable or inserted in said opening in said joint piece; and an attachment portion connected to the guide rail, said attachment portion having two lateral legs and a connection leg between said two lateral legs, said connection leg having a through opening formed therein for receiving said fastening bolt, and said two lateral legs having mutually aligned joint grooves each configured for receiving a respective one of said joint pins of said joint piece;

said main body of said joint piece being pivoted between said lateral legs in a direction of said connection leg and said main body being pivotably mounted in said attachment portion.

2. The fastening device according to claim 1, wherein said joint pins of said joint piece each have two respective mutually opposite flat sides as guide faces.

3. The fastening device according to claim 1, wherein said joint pins of said joint piece have two mutually opposite radiused or arcuate joint sides as joint faces.

4. The fastening device according to claim 1, wherein said joint grooves of said attachment portion each have an introduction portion, a constriction adjoining said introduction portion in a groove longitudinal direction, and a groove portion forming a joint socket for receiving a respective one of said joint pins of said joint piece.

5. The fastening device according to claim 1, wherein said main body of said joint piece is cylindrical and has a shell and a joint web being integrally molded on and running tangentially to said shell, said joint pins each being disposed on a respective end side of said joint web.

6. The fastening device according to claim 1, wherein said joint grooves have groove legs, and a detent periphery is integrally molded on at least one of said joint pins for bearing said joint piece on at least one of said groove legs.

7. The fastening device according to claim 1, wherein:

said opening of said joint piece is a through opening having an internal thread; and at least one of:

said first shank portion of said fastening bolt has an external thread communicating with said internal thread on said joint piece; or said opening of said joint piece is eccentric relative to said through opening of said attachment portion.

8. The fastening device according to claim 1, which further comprises at least one annular detent disposed on said fastening bolt or disposed between said first and second shank portions for at least one of:

bearing on said joint piece for bearing on a frame part or module part or a vehicle door, or acting as a detent on an opening periphery of said through opening of said attachment portion for delimiting a pivoting movement of said joint piece.

9. A vehicle window lifter, comprising the at least one guide rail, and the fastening device according to claim 1.

10. A fastening device for a vehicle window lifter having at least one guide rail for displaceably guiding a driver for a window glass, the fastening device comprising:

a joint piece having two joint pins being integrally molded on said joint piece and being disposed mutually opposite axially along a rotation axis;

a fastening bolt having first and second shank portions, said first shank portion being integrated in said joint piece; and an attachment portion connected to the guide rail, said attachment portion having two lateral legs and a connection leg between said two lateral legs, said connection leg having a through opening formed therein for receiving said fastening bolt, and said two lateral legs having mutually aligned joint grooves each configured for receiving a respective one of said joint pins of said joint piece;

said joint piece being pivoted between said lateral legs in a direction of said connection leg and said joint piece being pivotably mounted in said attachment portion.

11. The fastening device according to claim 10, wherein said joint pins of said joint piece each have two respective mutually opposite flat sides as guide faces.

12. The fastening device according to claim 10, wherein said joint pins of said joint piece have two mutually opposite radiused or arcuate joint sides as joint faces.

13. The fastening device according to claim 10, wherein said joint grooves of said attachment portion each have an introduction portion, a constriction adjoining said introduction portion in a groove longitudinal direction, and a groove portion forming a joint socket for receiving a respective one of said joint pins of said joint piece.

14. The fastening device according to claim 10, wherein said main body of said joint piece is cylindrical and has a shell and a joint web being integrally molded on and running tangentially to said shell, said joint pins each being disposed on a respective end side of said joint web.

15. The fastening device according to claim 10, wherein said joint grooves have groove legs, and a detent periphery is integrally molded on at least one of said joint pins for bearing said joint piece on at least one of said groove legs.

16. The fastening device according to claim 10, wherein:

said opening of said joint piece is a through opening having an internal thread; and at least one of:

said first shank portion of said fastening bolt has an external thread communicating with said internal thread on said joint piece; or said opening of said joint piece is eccentric relative to said through opening of said attachment portion.

17. The fastening device according to claim 10, which further comprises at least one annular detent disposed on said fastening bolt or disposed between said first and second shank portions for at least one of:

bearing on said joint piece for bearing on a frame part or module part or a vehicle door, or acting as a detent on an opening periphery of said through opening of said attachment portion for delimiting a pivoting movement of said joint piece.

18. A vehicle window lifter, comprising the at least one guide rail, and the fastening device according to claim 10.

* * * * *